US007080689B2

(12) United States Patent
Guesnon et al.

(10) Patent No.: US 7,080,689 B2
(45) Date of Patent: Jul. 25, 2006

(54) INSTRUMENTATION ASSEMBLY FOR AN OFFSHORE RISER

(75) Inventors: Jean Guesnon, Chatou (FR); Olivier Vaisberg, Paris (FR); Guy Pignard, Rueil Malmaison (FR); Pierre Guerin, Toulon (FR)

(73) Assignee: Institut Francais du Petrole, Cedex (FR)

( * ) Notice: Subject to any disclaimer, the term of this patent is extended or adjusted under 35 U.S.C. 154(b) by 88 days.

(21) Appl. No.: 10/459,521

(22) Filed: Jun. 12, 2003

(65) Prior Publication Data

US 2003/0230409 A1 Dec. 18, 2003

(30) Foreign Application Priority Data

Jun. 13, 2002 (FR) ..... 02 07245

(51) Int. Cl.
*E21B 29/1221* (2006.01)

(52) U.S. Cl. ..... 166/355; 166/367; 405/224.4; 702/6

(58) Field of Classification Search ..... 166/350, 166/353, 354, 355, 359, 367; 175/7; 405/224.2, 405/224.4; 702/6, 9; 701/116
See application file for complete search history.

(56) References Cited

U.S. PATENT DOCUMENTS

| | | | | |
|---|---|---|---|---|
| 3,653,635 | A * | 4/1972 | Bates et al. | 254/392 |
| 3,760,875 | A * | 9/1973 | Busking | 166/354 |
| 4,024,718 | A * | 5/1977 | Roche et al. | 405/190 |
| 4,044,473 | A * | 8/1977 | Crask | 33/333 |
| 4,205,379 | A * | 5/1980 | Fox et al. | 701/116 |
| 4,317,174 | A | 2/1982 | Dean | |
| 4,921,048 | A * | 5/1990 | Crow et al. | 166/372 |
| 5,704,427 | A * | 1/1998 | Buck et al. | 166/338 |
| 5,978,739 | A | 11/1999 | Stockton | |
| 6,364,021 | B1 * | 4/2002 | Coats | 166/350 |
| 6,808,021 | B1 * | 10/2004 | Zimmerman et al. | 166/381 |

FOREIGN PATENT DOCUMENTS

| | | |
|---|---|---|
| EP | 0 922 836 A1 | 6/1999 |
| FR | 2 375 431 | 7/1978 |
| GB | 2 372 765 | 2/2001 |

* cited by examiner

*Primary Examiner*—Jennifer H. Gay
*Assistant Examiner*—Thomas A Beach
(74) *Attorney, Agent, or Firm*—Antonelli, Terry, Stout and Kraus, LLP.

(57) ABSTRACT

The present invention relates to an instrumentation assembly intended for an offshore riser (2) operated from a floater (1). It comprises a central processing unit (PC) connected by conducting cables (27) to:

- a plurality of modules (21–25) fastened to various points of the riser length, the modules comprising measuring means allowing dynamic location of said points in space,
- another locating module (26) fastened to the lower end (LMRP) of said riser,
- a series of detectors (W, C, M/W) for measuring the environment: wind, wave, current,
- an assembly for measuring the position (DGPS, P) of the floater.

The measurements are synchronized with one another, managed and recorded by means of the central processing unit.

21 Claims, 2 Drawing Sheets

28
29
PC
P
DGPS
DRG
PUP
31
21
27
32
22
W
C
M/W
33
23
30
34
24
37
35
25
36
LMRP
26

INSTRUMENTATION ASSEMBLY FOR AN OFFSHORE RISER

FIELD OF THE INVENTION

The present invention relates to the development of deep offshore oil reservoirs, i.e. at water depths above 1000 meters, in particular above 2000 m. To produce such reservoirs, the production well drilling operations require heavy and therefore costly installations, which involves surveys and techniques specific to the local conditions. Industrialists in the profession currently have a certain number of computer programs allowing complex computations to optimize the installations according to specifications. However, at such depths, the problems are such that the computing programs are currently not totally validated for extreme conditions: water depth, wind, current, etc.

The present invention relates to a deep-water drilling installation allowing to control all of the stresses and deformations undergone by the riser considering the oceanographical and operating conditions. What is referred to as control is real-time, pseudo-real time, or not, recording and monitoring of the parameters allowing to analyse the stresses undergone by the riser.

The main object of the invention is to acquire a maximum of data on the behaviour of a riser under determined conditions. The displacements, the deformations, the stresses are therefore recorded together with the outside loads and actions.

SUMMARY OF THE INVENTION

The invention thus relates to an instrumentation assembly intended for an offshore riser operated from a floater. The assembly comprises a central processing unit (PC) connected by conducting cables to:

- a plurality of modules fastened to various points of the riser length, said modules comprising measuring means allowing dynamic location of said points in space,
- another locating module fastened to the lower end (LMRP) of said riser,
- a series of detectors (W, C, M/W) for measuring the environment: wind, wave, current,
- an assembly for measuring the position (DGPS, P) of the floater, said measurements being synchronized with one another, managed and recorded by means of the central processing unit.

An upper element of the riser can be instrumented to measure (PUP) the tension and the flexion at the top of the riser and connected to said central processing unit.

Tensioning means on the riser can comprise detectors for measuring their dynamic operation.

The modules can comprise stand-alone means such as memories and batteries so as to be able to work in case of a fault in the link with the central processing unit.

An acoustic system can comprise beacons fastened to the same points of the riser as said modules so as to locate it.

The assembly can include at least four modules.

BRIEF DESCRIPTION OF THE FIGURES

Other features and advantages of the present invention will be clear from reading the description hereafter of a non-limitative embodiment, with reference to the accompanying figures wherein.

DETAILED DESCRIPTION

Figure 1:
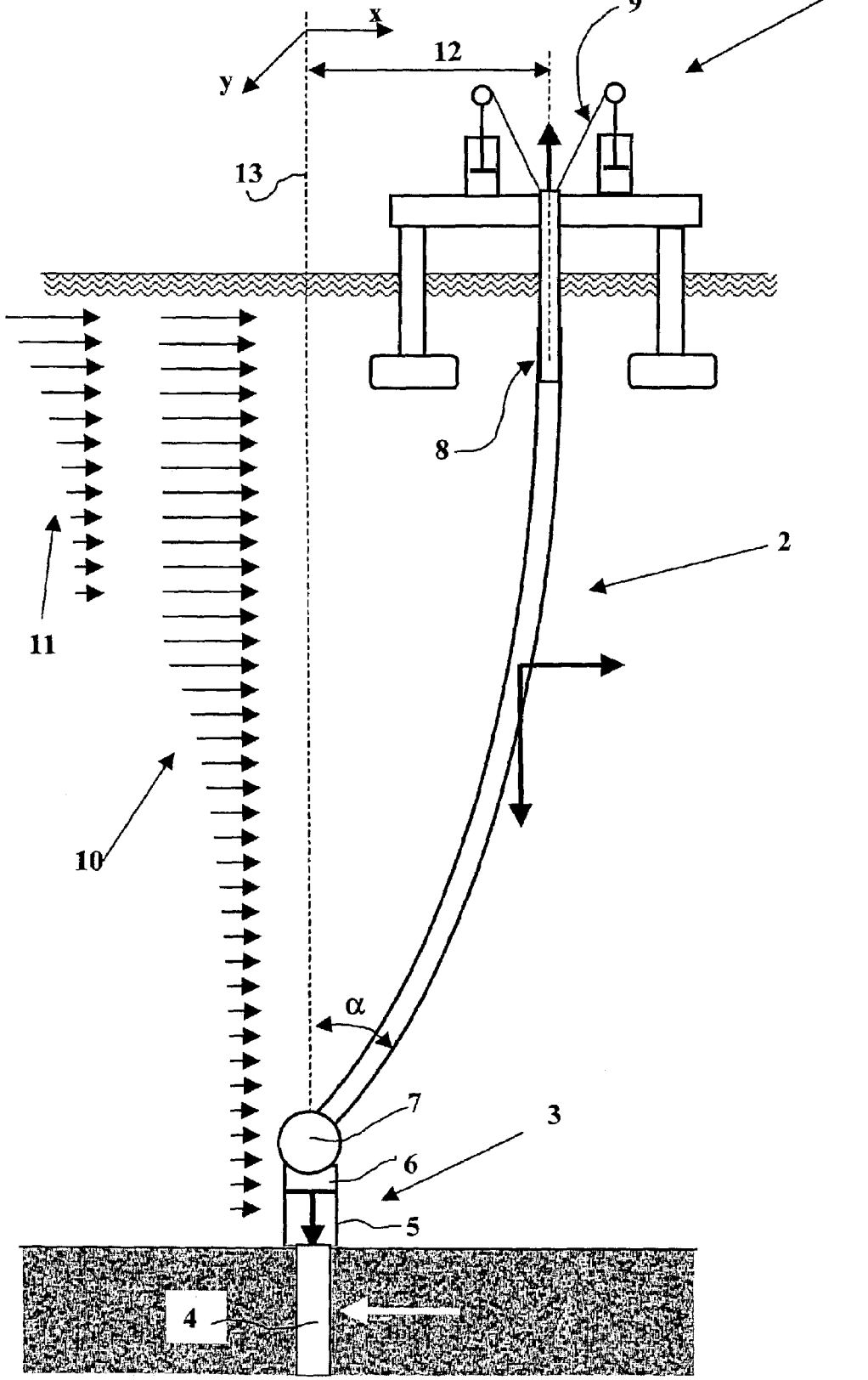
FIG. 1 diagrammatically shows an offshore drilling installation in its environment, FIG. 2 diagrammatically shows all of the detectors according to the invention and the acquisition system.

FIG. 1 shows the global architecture of an offshore drilling installation operated from a floater 1. This type of installation requires a riser 2 consisting of an assembly of elements connected to one another. The riser connects the floater to subsea wellhead 3. Wellhead 3 consists of a conductor pipe 4 sealed in the sea bottom, elements that support safety preventers 5, which comprise an upper part LMRP (Lower Marine Riser Package) 6 that can be separated from the lower part by means of a connector. Upper part LMRP remains suspended from the riser in the disconnected mode. In the connected mode, the base of the riser can be inclined at an angle $\alpha$ by means of knuckle type joint 7. The upper part of riser 2 is fastened to floater 1 by a telescopic joint 8 which allows to take up the vertical displacements due to the waves, and by a system of tensioners 9 generally consisting of cables, pulleys and hydropneumatic jacks that maintain the riser under tension and allow its deflected shape to be controlled.

Arrows 10 represent the current conditions, velocities, amplitudes, directions applied to riser 2. Arrows 11 represent the wave and swell conditions. Reference number 12 illustrates the displacement of the floater in relation to the vertical 13 of the wellhead.

The object of the present invention is to help solve the mechanical problems of the drilling installation, in particular the riser, such as the dynamic behaviour of the riser in the connected and disconnected mode, the consequences of strong currents, in particular vortex-induced vibrations (VIV), and more generally the fatigue strength of the riser.

The essential characteristics of the present invention can be summed up as follows:

- the riser is controlled both in the mode where it is connected to the wellhead and in the disconnected mode,
- the data provided by the detectors and recorded are compared with the results obtained by the dedicated software DeepDRiser (™ IFP/Principia), or any other similar software,
- the recorded data relate to: the riser, the lower end of the riser (LMRP), the tensioning system, the telescopic joint, the displacement of the floater, the environment,
- the data acquisition system is suited to the drilling procedures,
- a long-baseline acoustic system is used to know the position of the end of the riser (LMRP) in the disconnected mode.

By means of the system according to the invention, the data allow to study:

- the quasi-static deflected shape of the riser subjected to the current,
- the dynamic variation of the profile (deflected shape) due to the waves and to the displacements of the floater,
- the amplitude and the frequency of the vortex-induced vibrations (VIV),
- the hydrodynamic loads,
- the behaviour of the tensioners (in the connected mode),
- the tension at the riser top,
- the dynamic variations of the tension at the top considering the equivalent stiffness of the tensioning system (in the connected mode), the axial dynamic behaviour of the riser (in the connected and disconnected mode), the coupling of the tension/flexion modes to assess the risk of dynamic buckling of the upper part of the riser, the transient behaviour during disconnection of the riser.

Figure 2:
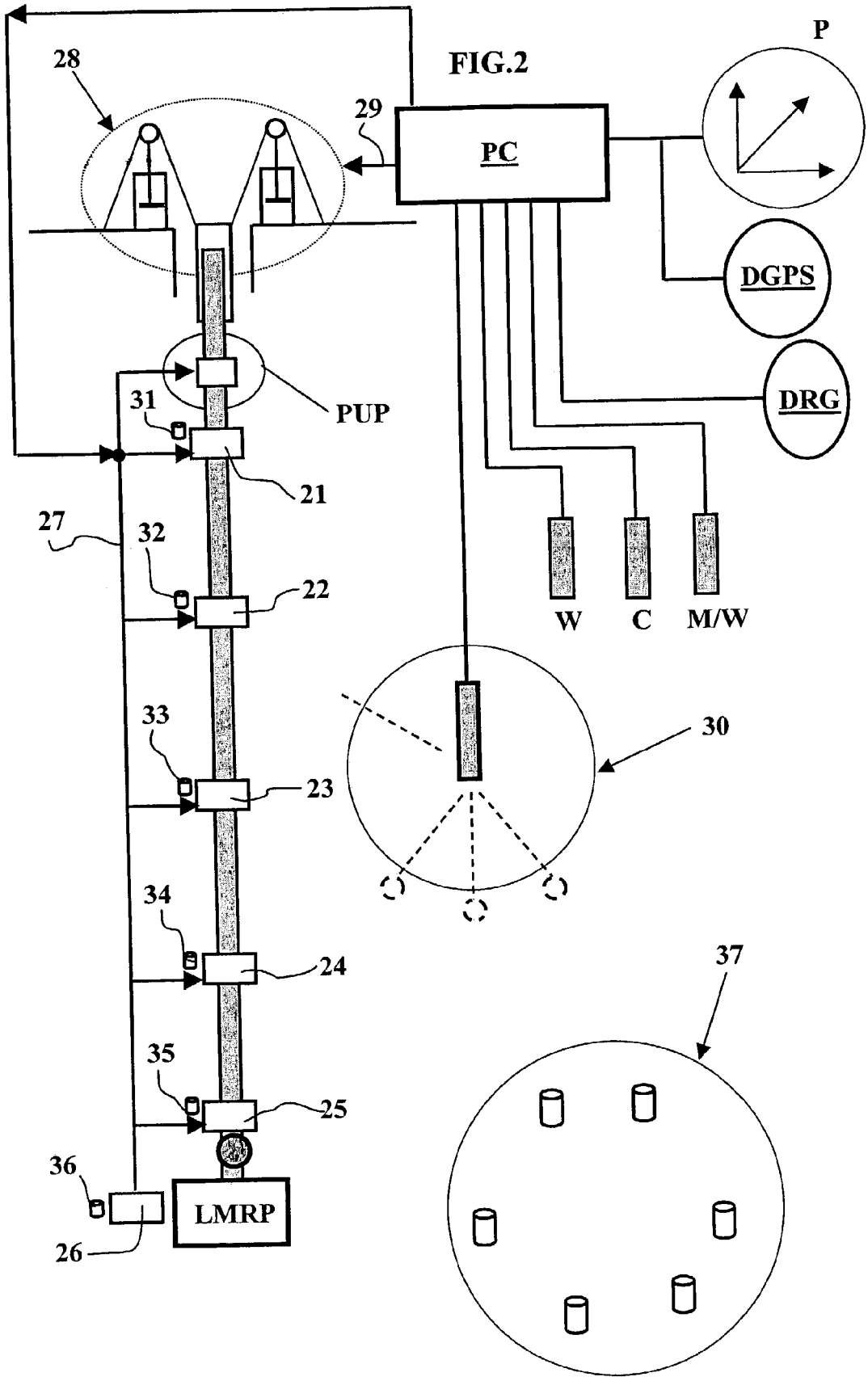

FIG. 2 diagrammatically shows the acquisition and control network of the drilling installation. A central processing unit PC is connected to a series of detectors to:

supply the detectors with electric power, record the data, synchronize the data with one another, provide a line for continuous control of the detectors.

The network can be subdivided into three subsystems:

Subsystem 1: it comprises six series of detectors:

W gives the wave height,

C gives the velocity and the direction of the current,

M/W gives weather information such as the direction and the velocity of the wind, the atmospheric pressure, DGPS gives the displacements of the floater according to the six degrees of freedom, P gives the position of the floater along two axes x and y.

The technology of these detectors is known in the profession, they are selected according to the expected conditions and to a determined plan.

Subsystem 2: it mainly comprises six series of detectors (reference numbers 21, 22, 23, 24, 25, 26) whose housings are fastened to four riser elements distributed according to circumstances, and two (25 and 26) are arranged in the vicinity of the end LMRP of the riser and surround joint 7. The six housings are connected together and to the surface by a cable 27. Each housing contains three accelerometers allowing dynamic location of a cylinder section (a part of the riser) in space. The housings also contain two inclinometers, or equivalent system, allowing to determine the static deflected shape of the riser. If the cable link is broken, each housing can work under stand-alone conditions by means of memories and batteries. In this case, the sampling frequency is reduced. Thus, whether during the descent of the riser or after connection to the wellhead, the deflected shape of the riser can be known and recorded in synchronism with the outside conditions: winds, currents, waves, . . . Transmission cable 27 can comprise 4 lines: two for data transmission and two for power supply.

Cable 27 is also connected to the detectors PUP fastened to a tubular element (pup-joint) for measurement of the axial load or tension, and of the bending moments along two axes.

All of the detectors 28 diagrammatically shown at the top of the riser in FIG. 2 are intended for measurements allowing to control and to operate the tensioning system of the riser, a system consisting of a certain number of identical subsystems. Each tensioning subsystem comprises at least a cable, a system of pulleys that cooperate with a hydraulic jack. In order to monitor and to control the operation of the tensioning system, the tension is measured at the ends of at least one cable to evaluate the efficiency of the pulleys and the displacement of the jack rod. The hydraulic system is a passive system intended to control the pressure in the jacks, obtained by oleopneumatic accumulators. The gas pressure in these accumulators, whose value is adjusted according to the required tension, is also measured and recorded.

The assembly of detectors 28 connected to central processing unit PC by conductors 29 also comprises recording the displacement of the telescopic joint systematically installed at the top of the riser to admit the heave of the floater.

This assembly can also comprise measuring the tension on the drilling cable and the weight on the spider on which rests the riser during its descent or in the disconnected mode.

Subsystem 2 also comprises assembly DRG which gives the drilling measurements, i.e.: tension at the top of the drill string, density of the drilling fluid, rotating speed of the bit, pressure in the safety lines (KL and CL), depth of the riser end (LMRP), this information being obtained from the measuring system of the drilling installation.

The network consists of links by means of conductor cables to a central processing unit PC. This central unit controls:

data transfer organization, measurement acquisition, detectors synchronization, data display, measurement recording, modification of the acquisition parameters by an operator, the frequency for example.

Such a network allows real-time monitoring of the stresses, deformations and positioning of the riser whether during its descent, or disconnected mode, or in the connected mode, i.e. during drilling.

Subsystem 3: it consists of an acoustic system diagrammatically represented by detector 30 connected to central unit PC.

A certain number of acoustic beacons 31 to 37 fastened at determined points allow to locate them. The beacons fastened to the standard length of the riser (31 to 34) can serve as a redundant safety for the other system measuring the deflected shape of the riser. Beacons 35 and 36 allow to locate the lower end of the LMRP. The other beacons 37 that lie on the sea bottom are used to locate the floater.

The invention claimed is:

1. An instrumentation assembly for use with an offshore riser operated from a floating platform comprising:

a system for controlling the riser;

a central processing unit for connection by cables to a plurality of modules for fastening to separated points along a length of the riser, the modules comprising measuring units for dynamically locating in real time the points in space and for controlling the system for controlling the riser;

another locating module for fastening to a lower end of the riser for locating the lower end of the riser;

detectors for measuring environmental conditions; and an assembly for measuring a position of the floating platform; and wherein the central processing unit synchronizes in real time with one another, manages and records measurements from the measuring units, detectors, and assembly and in real time monitors stress, deformation and positions of the riser in controlling the system.

2. An assembly as claimed in claim 1, wherein:

an upper element of the riser includes instruments for measuring tension in the riser and flexion at a top of the riser and are connected to the central processing unit.

3. An assembly as claimed in claim 1 comprising:

a tensioner for tensioning the riser which comprises detectors for measuring dynamic behavior of the riser.

4. An assembly as claimed in claim 2 comprising:

a tensioner for tensioning the riser which comprises detectors for measuring dynamic behavior of the riser.

5. An assembly as claimed in claim 1, wherein:

the modules operate in a stand-alone mode to work in case of a fault in link between the modules and the central processing unit.

6. An assembly as claimed in claim 2, wherein:

the modules operate in a stand-alone mode to work in case of a fault in link between the modules and the central processing unit.

7. An assembly as claimed in claim 3, wherein:

the modules operate in a stand-alone mode to work in case of a fault in link between the modules and the central processing unit.

8. An assembly as claimed in claim 5 wherein:

the modules each comprise a memory and a battery.

9. An assembly as claimed in claim 6 wherein:

the modules each comprise a memory and a battery.

10. An assembly as claimed in claim 7 wherein:

the modules each comprise a memory and a battery.

11. An assembly as claimed in claim 1 comprising:

an acoustic system including beacons, the beacons being fastened at the points of the riser at which the modules are located to locate the modules.

12. An assembly as claimed in claim 2 comprising:

an acoustic system including beacons, the beacons being fastened at the points of the riser at which the modules are located to locate the modules.

13. An assembly as claimed in claim 3 comprising:

an acoustic system including beacons, the beacons being fastened at the points of the riser at which the modules are located to locate the modules.

14. An assembly as claimed in claim 4 comprising:

an acoustic system including beacons, the beacons being fastened at the points of the riser at which the modules are located to locate the modules.

15. An assembly as claimed in claim 5 comprising:

an acoustic system including beacons, the beacons being fastened at the points of the riser at which the modules are located to locate the modules.

16. An assembly as claimed in claim 6 comprising:

an acoustic system including beacons, the beacons being fastened at the points of the riser at which the modules are located to locate the modules.

17. An assembly as claimed in claim 7 comprising:

an acoustic system including beacons, the beacons being fastened at the points of the riser at which the modules are located to locate the modules.

18. An assembly as claimed in claim 8 comprising:

an acoustic system including beacons, the beacons being fastened at the points of the riser at which the modules are located to locate the modules.

19. An assembly as claimed in claim 9 comprising:

an acoustic system including beacons, the beacons being fastened at the points of the riser at which the modules are located to locate the modules.

20. An assembly as claimed in claim 10 comprising:

an acoustic system including beacons, the beacons being fastened at the points of the riser at which the modules are located to locate the modules.

21. An assembly as claimed in claim 1, comprising:

at least four modules.

* * * * *